US012232656B2

(12) United States Patent
Murphy et al.

(10) Patent No.: US 12,232,656 B2
(45) Date of Patent: Feb. 25, 2025

(54) DISPENSER PROFILES FOR USAGE OPTIMIZATION

(71) Applicant: GPCP IP Holdings LLC, Atlanta, GA (US)

(72) Inventors: David Warren Murphy, Neenah, WI (US); Brian S. Borke, Appleton, WI (US); Ryan A. Goltz, Neenah, WI (US); Timothy A. Robertson, Appleton, WI (US); Philip R. Walker, Oshkosh, WI (US)

(73) Assignee: GPCP IP HOLDINGS LLC

( * ) Notice: Subject to any disclaimer, the term of this patent is extended or adjusted under 35 U.S.C. 154(b) by 734 days.

(21) Appl. No.: 17/467,981

(22) Filed: Sep. 7, 2021

(65) Prior Publication Data

US 2022/0079394 A1 Mar. 17, 2022

Related U.S. Application Data

(60) Provisional application No. 63/077,083, filed on Sep. 11, 2020.

(51) Int. Cl.
*A47K 10/36* (2006.01)
*A47K 10/32* (2006.01)

(52) U.S. Cl.
CPC ..... *A47K 10/36* (2013.01); *A47K 2010/3226* (2013.01); *A47K 2010/3668* (2013.01)

(58) Field of Classification Search
CPC ..... A47K 10/36
See application file for complete search history.

(56) References Cited

U.S. PATENT DOCUMENTS

| | | | | |
|---|---|---|---|---|
| 6,411,920 | B1 | 6/2002 | Mcconnell | |
| 6,592,067 | B2 | 7/2003 | Denen | |
| 7,594,622 | B2 | 9/2009 | Witt et al. | |
| 7,783,380 | B2 | 8/2010 | York et al. | |
| 7,942,290 | B2 * | 5/2011 | Halliburton | G07F 17/42 221/26 |
| 7,984,872 | B2 | 7/2011 | Kuehneman | |
| 9,089,246 | B2 | 7/2015 | Borke | |
| 9,144,352 | B2 | 9/2015 | Cittadino et al. | |
| 9,999,326 | B2 | 6/2018 | Borke et al. | |
| 10,130,221 | B2 | 11/2018 | Borke | |
| 10,365,139 | B2 | 7/2019 | Singh et al. | |
| 2009/0198373 | A1 * | 8/2009 | Mok | A47K 10/36 221/36 |
| 2016/0325957 | A1 * | 11/2016 | Borke | A47K 10/36 |
| 2018/0368626 | A1 | 12/2018 | Williams, Jr. et al. | |

* cited by examiner

*Primary Examiner* — Gene O Crawford
*Assistant Examiner* — Ayodeji T Ojofeitimi

(57) ABSTRACT

Disclosed are various examples of automated dispensers to dispense consumable products, such as paper towels, gels, liquids, gases, aerosols, foams, and other consumables. Automated dispensers can operate in various modes. Examples of the disclosure can utilize a dispense profile to adjust the speed at which consumable products are dispensed.

22 Claims, 7 Drawing Sheets

DISPENSER PROFILES FOR USAGE OPTIMIZATION

CROSS-REFERENCE TO RELATED APPLICATIONS

This application claims priority to, and the benefit of, U.S. Provisional Patent Application No. 63/077,083, filed on Sep. 11, 2020 and entitled "DISPENSER PROFILES FOR USAGE OPTIMIZATION," which is incorporated by reference as if set forth herein in its entirety.

BACKGROUND

Automated dispensers are utilized in various environments to facilitate and optimize dispensing of consumable products, such as paper towels, gels, liquids, gases, aerosols, foams, and other consumables. Automated dispensers can operate in various modes. For example, an automated dispenser can dispense a predetermined or variable quantity of a consumable in response to detecting movement or presence in proximity to the automated dispenser. For example, a user's hand, arm, or body can be detected in proximity to the automated dispenser by a user sensor. The user sensor can be a proximity or motion sensor that provides a proximity signal to a controller. In some modes, in response to the proximity signal, the automated dispenser can provide a quantity of the consumable product.

As another example, an automated dispenser can be configured to operate in a "hang-mode." In the hang-mode, a tear sensor, also referred to herein as a removal sensor, can detect when a portion of a sheet product has been torn or separated from a product roll. The removal sensor can generate a removal signal, or a tear signal, that is provided to a controller. In response to the tear signal, the controller can cause the automated dispenser to dispense additional amount of product from the product roll. In commercial and office settings, reducing product waste can yield significant savings on consumable items. Accordingly, automated dispensers can be a component of a strategy to minimize waste while also providing a consistent user experience.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
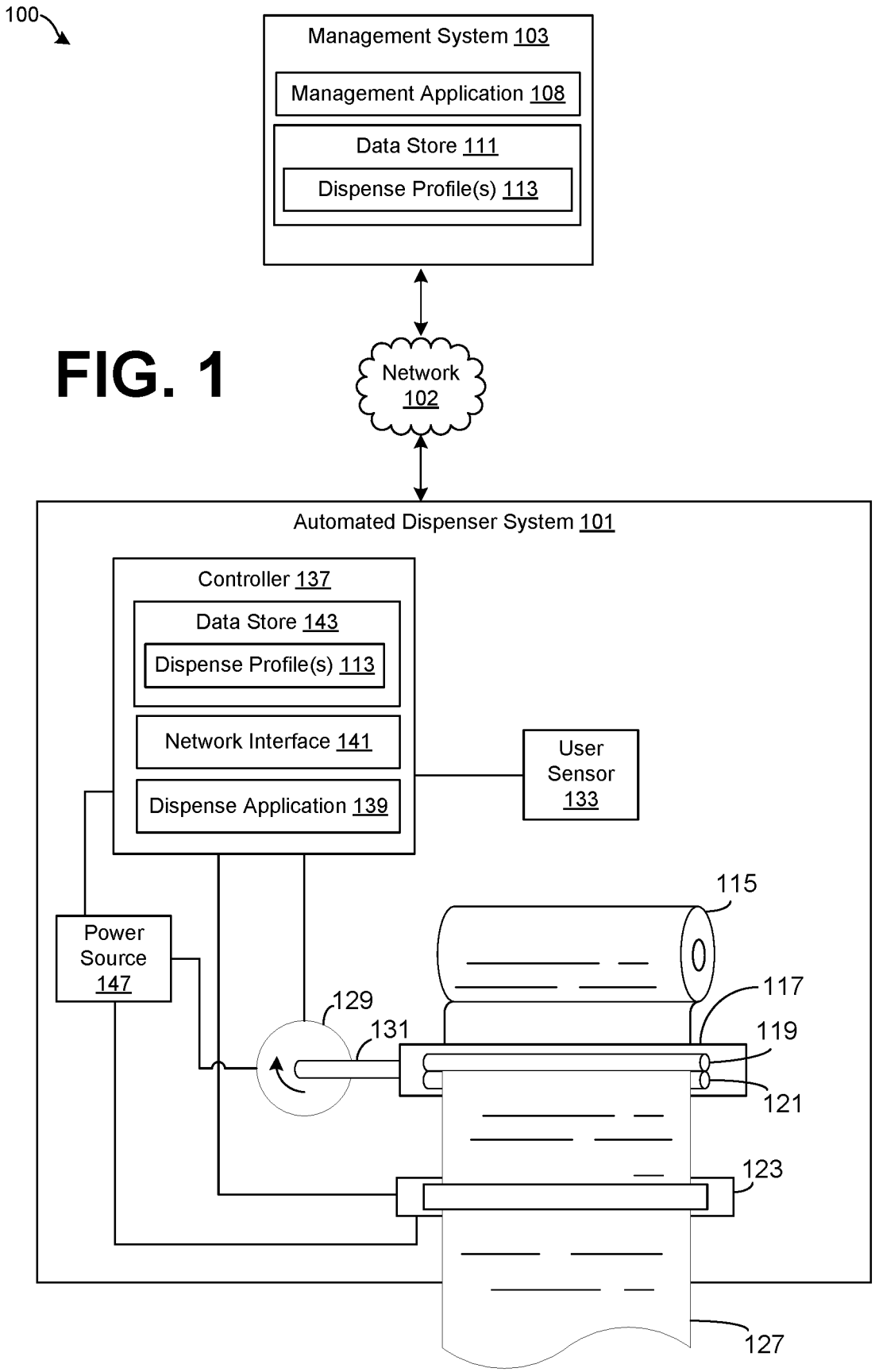
FIG. 1 is a drawing of an example environment according to embodiments of the disclosure.

The present disclosure relates to systems for optimizing dispensing of consumable products by an automated dispenser system. Automated dispenser systems can be used in various settings to dispense consumable products such as sheet product, paper towels, or tissues. The term "sheet products" is inclusive of natural and/or synthetic cloth or paper sheets. Further, sheet products can include both woven and non-woven articles. Examples of sheet products include, but are not limited to, wipers, napkins, tissues, and towels. For ease in discussion, however, reference is hereinafter made to embodiments particularly suited for paper products. The dispensing of the consumable product can be affected by adjusting the speed with which a controller application causes a motor, and in some cases one or more motors, to be driven during a dispense cycle. A dispense cycle refers to the period of time during which the motor is extracting product from a product source, such as one or more product rolls stored within the automated dispenser system. The motor can be mechanically coupled to a mechanical dispensing system to dispense the consumable product. For example, the mechanical dispensing system can include a dispense mechanism that extracts sheet product, such as paper towel or tissue, from a product roll and presents a length of the sheet product to the user.

The speed with which the motor is driven to provide an amount of sheet product to the user can be varied according to embodiments of the disclosure. Varying the speed of the motor driving the dispense mechanism can cause a specified amount of sheet product to be presented more quickly or slowly depending upon the selected speed of the motor. Varying the speed with which the consumable product is presented to the user can achieve various objectives.

Slowing the speed of the motor, which slows the speed with which a sheet of paper towel or tissue is presented to the user, can potentially influence a user to remove or tear the sheet of paper exiting the dispenser earlier than when the motor is run at a faster speed. Should the user tear the sheet of paper before the full, specified length of a sheet is presented, the automated dispenser system can cease dispensing the sheet until the next user requests a sheet, which can in turn reduce waste.

However, slowing the speed of the motor too much or in too many situations, while potentially reducing waste and consumption of the consumable product, can impair the user experience in various ways. For example, in high traffic environments, such as airports, arenas, stadiums, or other areas that experience high traffic, slowing the speed of a motor driving a dispense mechanism too much can result in the automated dispenser system becoming a bottleneck in a washroom environment. Additionally, slowing the speed of the motor for all scenarios can result in a subpar user experience, which can generate a higher volume of complaints or trouble tickets, which can outweigh the benefits of reducing waste.

Therefore, embodiments of the disclosure can facilitate the creation and deployment of dispense profiles to automated dispenser systems. The dispense profiles can be tailored to a particular environment in which the automated dispenser system is deployed and can achieve a balance between reducing usage of a consumable product and the user experience. Additionally, dispense profiles can be updated in the automated dispenser system over time and "over-the-air," so the dispense profiles can evolve over time and evolve as the usage scenario of an automated dispenser system similarly evolves.

Referring next to FIG. 1, shown is an example environment 100 in which an automated dispenser system 101 can be deployed. The environment 100 can include one or more automated dispenser systems, 101, a management system 103, and potentially other devices that are connected to a network 102. The automated dispenser system 101 shown in FIG. 1 can represent a population of many automated dispenser systems 101 that are deployed in various facilities. The automated dispenser system 101 can communicate with the management system 103 to obtain configuration and software updates. The management system 103 can manage one or more automated dispenser systems 101 that are deployed in various facilities or buildings. In some implementations, the management system 103 can be located at a facility in which the automated dispenser system 101 is installed and communicate with another management system 103 that is remotely located from the facility. In this configuration, a locally installed management system 103 can act as a local management agent on behalf of a backend management system 103 that is remote from the facility.

The network 102 can include the Internet, intranets, extranets, wide area networks (WANs), local area networks (LANs), wired networks, wireless networks, other suitable networks, or any combination of two or more such networks. The networks can include satellite networks, cable networks, Ethernet networks, telephony networks, and other types of networks.

The management system 103 can include a server computer or any other system providing computing capability. While referred to in the singular, the management system 103 can include a plurality of computing devices that are arranged in one or more server banks, computer banks, or other arrangements. The management system 103 can include a grid computing resource or any other distributed computing arrangement. The management system 103 can be customer or enterprise-specific. In some embodiments, the management system can be part of a local network and be positioned on the same local network as the automated dispenser system 101. In other embodiments, the management system 103 can be remote from the automated dispenser system 101. The management system 103 can also include or be operated as one or more virtualized computer instances. For purposes of convenience, the management system 103 is referred to herein in the singular. Even though the management system 103 is referred to in the singular, a plurality of management systems 103 can be employed in various arrangements.

The components executed on the management system 103 can include a management application 108 as well as other applications, services, processes, systems, engines, or functionality not discussed in detail herein. The management application 108 can represent an application or service that can remotely manage one or more automated dispenser systems 101.

The data store 111 can include any storage device or medium that can contain, store, or maintain the data for use by or in connection with the management application 108. The data store 111 can be a hard drive or disk of a host, server computer, or any other system providing storage capability. While referred to in the singular, the data store 111 can include a plurality of storage devices that are arranged in one or more hosts, server banks, computer banks, or other arrangements. The data store 111 can include any one of many physical media, such as magnetic, optical, or semiconductor media. More specific examples include solid-state drives or flash memory.

The data stored in the data store 111 can include one or more dispense profiles 113. A dispense profile 113 can specify the dispensing behavior of an automated dispenser system 101. The dispense profile 113, for example, can specify a speed, acceleration, frequency, and other properties and parameters utilized by an automated dispenser system 101 to dispense a consumable product, such as sheets of paper towels or tissue. The various aspects the dispensing behavior of an automated dispenser system 101 that can be tuned or adjusted by a dispense profile 113 are discussed in further detail herein.

An automated dispenser system 101 can represent a sheet product dispenser that can dispense a consumable product, such as sheet product, paper towels or tissues, in response to an input from one or more sensor inputs or other criteria. The automated dispenser system 101 can include a product supply 115, such as one or more rolls of a sheet product (e.g., tissue or paper towel). The automated dispenser system 101 can also include a feed mechanism 117 that can extract a portion of the sheet product from the product supply 115. In other words, the feed mechanism 117 can move sheet product out of the automated dispenser system 101 for presentation to a user.

The feed mechanism 117, in some implementations, can include a drive roller 119 and a pinch roller 121. The pinch roller 121 can be positioned in proximity to the drive roller to form a pinch or nip in between the pinch roller 121 and drive roller 119. In other words, the product supply 115 can be fed through the drive roller 119 and pinch roller 121 of the feed mechanism 117. The product supply 115 can be installed onto one or more roll holders from which a free end of the sheet product can be extracted through the feed mechanism 117 and external to the automated dispenser system 101, where a portion of the sheet can be presented to the user.

The automated dispenser system 101 can also include a removal sensor 123. The removal sensor can be integrated into an assembly and can detect when a portion of the sheet product presented to the user has been torn or removed from the automated dispenser system 101. In some embodiments, the removal sensor 123 can detect movement of a tear bar that is pivotably mounted to the automated dispenser system 101. In other example embodiments, the removal sensor 123 can include a stationary tear bar, a tear bail, and a switch in communication with the controller 137. In this example, to remove the portion 127 of the sheet product, a user can apply a force on the portion 127 against the stationary tear bar. As the portion 127 is pulled against the tear bar, contact can be made between the product sheet and the tear bail causing the tear bail to rotate into contact with the switch. Upon engagement with the tear bail, the switch can generate a signal indicating that a tear operation has taken place, which can then be communicated to the controller 137.

In operation, to remove a portion 127 of the product supply 115, a user applies a force on the portion 127, which can cause the portion 127 to engage a tear bar and pivot until an electrical connection is either made or broken, which can in turn cause the removal sensor 123 to generate a removal signal that indicates that the portion 127 of the product supply 115 has been removed or torn. In other words, the mechanical action of pulling on and removing the portion 127 can cause a removal signal to be generated, which again indicates that the portion 127 of the product supply 115 has been removed or torn.

The automated dispenser system 101 can also include a motor 129 or multiple motors that are mechanically coupled to the feed mechanism 117. The motor 129 can include a brushed direct current (DC) motor that is configured to actuate the feed mechanism 117 to extract product from the product supply 115. In some embodiments, the motor 129 can comprise a brushless DC motor. The motor 129 can be mechanically coupled to the feed mechanism 117 by way of a transmission 131. The transmission 131 can comprise a shaft that or system of shafts that, when actuated by the motor 129 in a drive direction, actuates the drive roller 119 or a gearing system coupled to the drive roller 119, which can in turn extract sheet product from the product supply 115. In some implementations, the drive roller 119 can be driven by a belt directly or indirectly coupled to the motor 129.

In some embodiments, the automated dispenser system 101 can be equipped with a motor encoder that generates feedback information about the rotational velocity of the motor 129. The motor encoder can analyze rotational velocity of the motor 129 to determine how much sheet product from the product supply 115 is extracted and presented to a user. In some embodiments, the amount of time and the speed with which a motor 129 is driven can be utilized to calculate how much sheet product is presented to a user during a dispense cycle.

The automated dispenser system 101 can include a user sensor 133 that can detect the presence of a user. The user sensor 133 can comprise one or more proximity sensors that can detect proximity of an object to the user sensor 133. The user sensor 133 can also comprise one or more motion sensors that can detect motion. The user sensor 133 can generate a proximity signal or motion signal in response to detection of an object within a threshold distance of the user sensor 133 and/or motion near the automated dispenser system 101. In practice, proximity of an object within a threshold distance of the user sensor 133 can be a user's hand, arm, or another body part, which can indicate, in certain operation modes, that a portion 127 of a sheet product should be dispensed from the automated dispenser system 101. The user sensor 133 can be implemented as an infrared or capacitive proximity sensor in some examples.

The automated dispenser system 101 can also include a controller 137 that can execute a dispense application 139. The controller 137 can represent a processor-based instruction execution system or computing device that can be equipped with memory, input/output interfaces, a network interface 141, a data store 143, and potentially other computing resources. The controller 137 can be a general purpose computing device or subsystem of the automated dispenser system 101 or a special purpose computing device that is integrated into the automated dispenser system 101. In some implementations, the controller 137 can be in an external housing or located remotely from the automated dispenser system 101. The network interface 141 represents a network capability of the controller 137 that allows the controller 137 to communicate with the network 102 and the management system 103.

The data store 143 can include any storage device or medium that can contain, store, or maintain the instructions, logic, or applications described herein for use by or in connection with the instruction execution system. The data store 143 can be flash storage, memory, a hard drive or disk of the controller 137, or any other system providing storage capability.

The data stored in the data store 143 can be associated with the operation of the various applications and/or functional entities described. The data stored in the data store 143 can comprise dispense profiles 113 that can be obtained from the management application 108. In some examples, the dispense profiles 113 can be stored in the data store 143 at the time of manufacture of the automated dispenser system 101. In other examples, the dispense profiles 113 can be loaded into the data store 143 using a local communication interface. A dispense profile 113 can specify the behavior of the automated dispenser system 101 in dispensing sheet product from the product supply 115.

A dispense profile 113 can specify a mode of operation for the automated dispenser system 101, the speed of the motor 129 when dispensing consumable product, and a length of the dispense cycle. The dispense profile 113 can also specify other parameters that define the behavior of an automated dispenser system 101 in dispensing product, such as those related to time of day, date, and other parameters that might influence the behavior of the automated dispenser system 101.

The dispense application 139, when executed by the controller 137, can obtain information from the various sensors in the automated dispenser system 101, such as the user sensor 133 and/or the removal sensor 123, and generate a signal to drive the motor 129 at a speed and for a period of time according to a dispense profile 113. The dispense application 139 can also obtain additional and/or updated dispense profiles 113 from the management application 108 that are provided to the automated dispenser system 101 over the network 102. A dispense profile 113 can be given an "over-the-air" (OTA) update from time to time. Additionally, the dispense application 139 itself can be updated from time to time by the management application 108. It should be noted that it is not required that an automated dispenser system 101 be remotely managed by the management application 108 in all implementations and that dispense profiles 113 can be stored on an automated dispenser system 101 for execution by the dispense application 139 at the time of manufacture.

The power source 147 can represent a battery system, an electrical system that can obtain power from an external power source, or a combination thereof. The power source 147 can be electrically coupled to the controller 137, the user sensor 133, motor 129, feed mechanism 117, removal sensor 123, and other components that require power. In some embodiments, each component requiring power in the automated dispenser system 101 can be coupled to its own power source or share power sources as groups or subgroups within the automated dispenser system 101.

Next, a description of how the controller 137 can facilitate the use of dispense profiles 113 to adjust the dispense behavior of the automated dispenser system 101 is provided. A dispense profile 113 can specify when the controller 137 should cause the motor 129 to actuate the feed mechanism 117 to cause a portion 127 of the consumable product to be dispensed. The dispense profile 113 can also specify the speed with which the consumable product is dispensed, and how much of the consumable product should be dispensed. The dispense profile 113 can also define a mode of operation of the automated dispenser system 101.

A first mode can include a proximity mode. In the proximity mode, the dispense profile 113 can specify that the controller 137 should cause product to be dispensed upon receiving a proximity or motion signal from the user sensor 133.

As another example, an automated dispenser can be configured to operate in a "hang-mode." In the hang-mode, removal sensor 123 integrated into the automated dispenser system 101 can detect when a portion 127 of sheet product has been torn or separated from a product roll. The removal sensor 123 can generate a removal signal that is provided to the dispense application 139. In response to the removal signal, the dispense application 139 can cause the automated dispenser system 101 to dispense additional sheet product from the product roll so that a portion 127 of the consumable product is ready for the next user.

According to embodiments of the disclosure, a dispense profile 113 can also specify further details and parameters that adjust the dispense behavior to minimize waste and offer different user experiences. The dispense profile 113 can cause the dispense application 139 to instruct the motor 129 to operate at different speeds in different situations. In a first example, a dispense profile 113 can cause the dispense application 139 to instruct the motor 129 to operate at a higher speed, full speed, or full power, for a first dispense cycle. If a subsequent dispense of the consumable product is signaled or requested by a user within a certain time threshold, such as within about ten seconds, the subsequent dispense can be performed at a lower speed. In other words, if a subsequent dispense occurs within a user timeout period, the dispense application 139 can cause the motor 129 to be operated at a lower speed for the dispense cycle.

In some examples, a dispense profile 113 can specify that different dispense cycles be utilized at different times of day, days of a week, or according to an event schedule. Dispense profiles 113 can also be selected by a user servicing the automated dispenser system 101 or by a user making a selection of a dispense profile 113 using a user interface provided by the management application 108 that is remotely managing an automated dispenser system 101.

Figure 2:
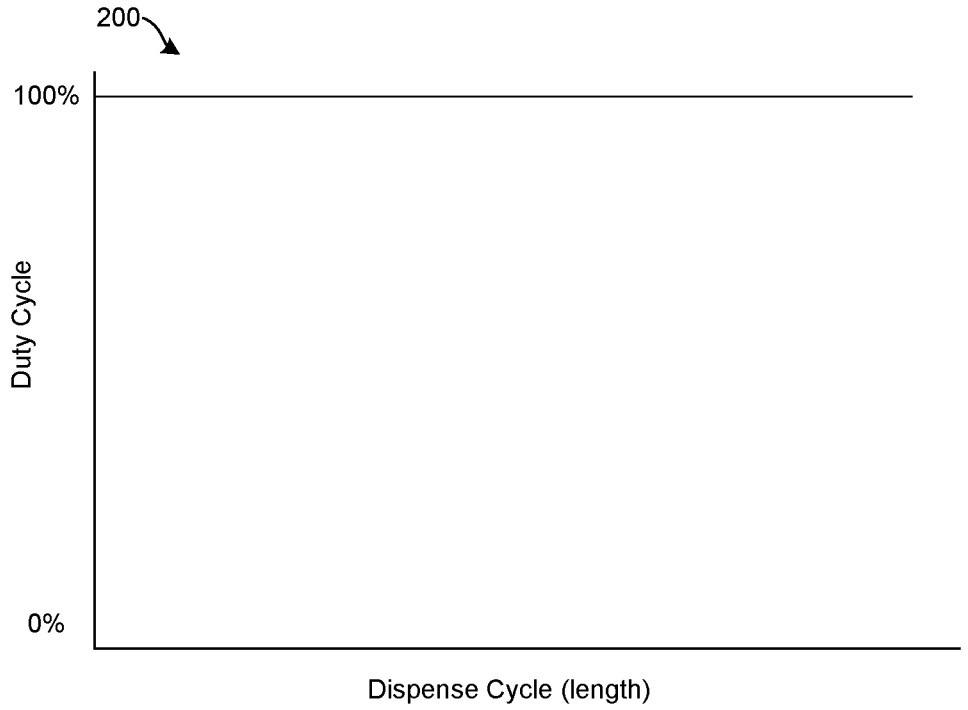
FIG. 2 is an example of a pulse width modulation graph for a portion of a dispense profile according to embodiments of the disclosure.
Figure 3:
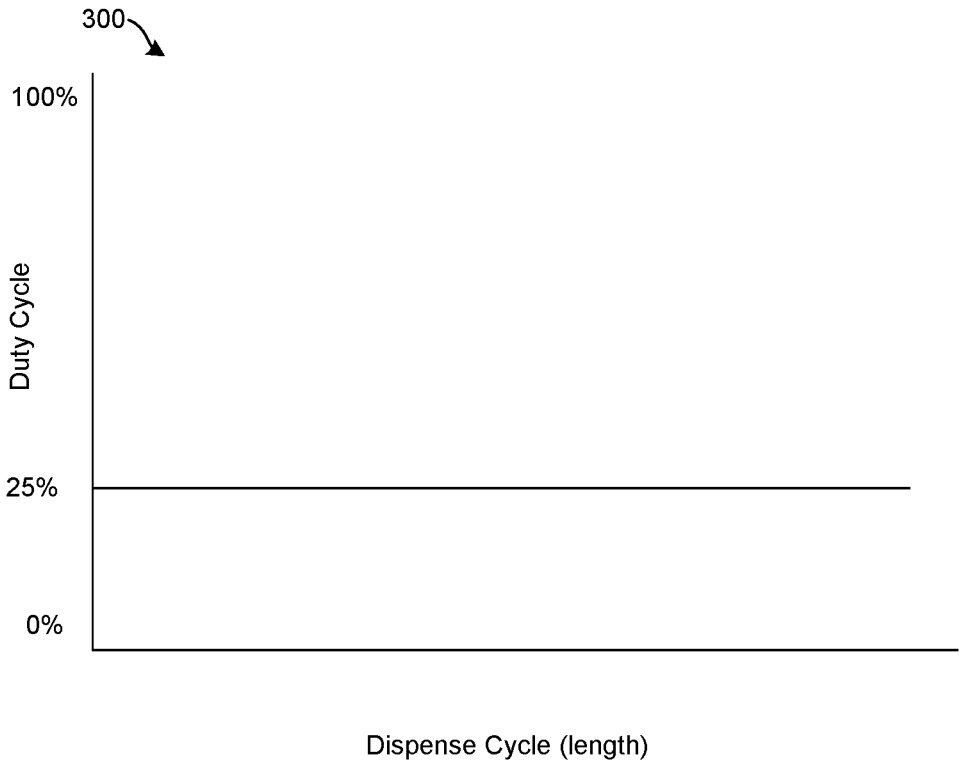
FIG. 3 is an example of a pulse width modulation graph for a portion of a dispense profile according to embodiments of the disclosure.

Reference is made to FIGS. 2-3, which illustrate an example of the dispense profile 113 described above. The graph 200 of FIG. 2 illustrates a first dispense cycle defined by the dispense profile 113, where the dispense cycle is configured to dispense a specified length of the sheet product from the product supply 115. The dispense profile 113 can specify that the first dispense cycle charted in graph 200 can be utilized when a previous dispensing of the consumable product occurred outside of a timeout threshold. In other words, the dispense profile 113 can specify that the motor 129 can be operated at a higher speed when the previous dispense of a sheet did not occur during a user timeout period, which can be counted from when a full amount of sheet product is dispensed in a previous dispense cycle in some embodiments. In other embodiments, the user timeout period can be counted from when the portion 127 of the sheet product is torn or removed from the automated dispenser system 101.

In the graph 200 of FIG. 2, the X-axis plots length of the consumable product dispensed, and the Y-axis plots the speed at which the motor 129 is directed to operate by the dispense application 139. The dispense application 139 can direct the motor 129 to operate at a particular speed by utilizing pulse width modulation (PWM) and specifying a duty cycle of the motor 129 during the dispense cycle with a PWM signal sent to the motor 129. Accordingly, in the example of FIG. 2, for a first dispense cycle, the dispense application 139 can select a peak or a 100% duty cycle. It should be noted that the first dispense cycle need not operate the motor 129 at a peak or 100% duty cycle depending upon the properties of the specific motor 129 selected for the automated dispenser system 101. The duty cycle for the first dispense cycle for the dispense profile 113 can simply be higher than the duty cycle for a second dispense cycle that occurs within the user timeout period, as is discussed below in the context of FIG. 3.

Continuing to FIG. 3, graph 300 illustrates the dispense cycle specified by the dispense profile 113 for a dispense that occurs within a user timeout period relative to a previous dispense of a portion 127 of sheet product. For a subsequent dispense within the user timeout period, an assumption is made that the same user is requesting a portion 127 of the consumable product. Because the assumption is that the same user is requesting an additional sheet of product, the dispense application 139 can instruct the motor 129 to operate at a lower speed by specifying a lower speed, or a lower duty cycle, for the motor 129. In the example of FIG. 3, the graph 300 illustrates that a 25% duty cycle can be chosen during the second dispense cycle within the user timeout period, which causes the specified length of the consumable product to be dispensed slower than the first dispense cycle illustrated by graph 200. Again, the lower duty cycle and slower motor 129 speed of graph 300 can be selected for subsequent dispense cycles that occur within the user timeout period relative to a previous dispense cycle. In other implementations, the lower duty cycle can be selected at different levels. For example, a 40% duty cycle can be chosen during the second dispense cycle within the user timeout period By selecting a slower motor 129 speed for subsequent dispense cycles within the user timeout period, user behavior can be influenced by encouraging the user to remove the dispensed sheet before it is fully dispensed to the specified length. It should be noted that the dispense profile 113 illustrated by FIGS. 2-3 causes a sheet of the same or equivalent length to be dispensed unless the dispense cycle is preemptively terminated, which the subsequent dispense cycle is designed to encourage. The parameter that varies between the two dispense cycles of the dispense profile 113 is the speed at which the sheet is dispensed. Therefore, if the user removes the dispensed sheet before it is fully dispensed, the removal sensor 123 can generate and send a removal signal to the dispense application 139, which can stop the current dispense cycle before it is completed. By stopping the current dispense cycle before it is completed, less consumable product is dispensed if the user removes the dispensed sheet before it is fully dispensed, and less consumable product is used or wasted during that dispense cycle.

Additionally, by only utilizing the lower motor speed for second and subsequent dispense cycles, the user experience is unaffected for subsequent users who request a sheet of the consumable product outside of the user timeout period, as the dispense cycle illustrated by graph 200 is utilized for these users. A user timeout period can be configured to be a few seconds or even a few minutes from a previous dispense of the consumable product. The user timeout period can be defined by a dispense profile 113 that is being utilized by the automated dispenser system 101. For example, the user timeout period can be 2-10 seconds, 20 seconds, or a quantity of seconds that is specified in a dispense profile 113. If a subsequent dispense occurs within the user timeout period, such as 10 seconds, an amount of sheet product can be dispensed at a different speed designed to discourage waste of the consumable product. It should be noted that the duty cycle discussed and illustrated in graph 200 and graph 300 is merely illustrative and that alternative duty cycles can be selected.

In some implementations, a lower motor speed can be utilized for a second and subsequent dispense cycle whenever presence of the user is detected. Presence of the user can be detected by various types of user sensors 133. Upon detecting presence of a user, a higher duty cycle can be used for the motor 129 for a first dispense cycle, and the lower duty cycle can be utilized for second and subsequent dispense cycles while presence of the same user is detected in proximity to the automated dispenser system 101. The higher duty cycle can be selected once a new or different user is detected in front of or in proximity to the automated dispenser system 101.

A radio frequency identifier (RFID) reader that detects an user badge or credential, facial recognition systems, and/or radar and proximity sensors that can track position and a quantity of users in the vicinity of the automated dispenser system 101 can be utilize to detect the presence of a first user and then the presence of a subsequent or different user.

Additionally, a dispense profile 113 can be selected based upon information gathered by a user sensor 133. For example, a user sensor 133 that can detect or discern an adult user versus a child user can result in selection of a different dispense profile 113 for the adult user versus the child user. The user sensor 133 could make such a distinction based upon the height or hand size of a user as detected at the automated dispenser system 101. Hand size could be detected using a capacitive hand sensor.

As another example a dispense profile 113 can be selected based upon time of day or consumption for the day. For example, if an arena or facility can select a particular dispense profile 113 optimized for speed to occur during half-time, intermission, or other high traffic periods of time associated with an event while selecting a dispense profile 113 optimized for reducing consumption during other time periods. As another example, a hospital could schedule a faster, louder profile when a patient is awake, or a slower, quieter profile during hours of sleep to minimize patient disturbance. A user sensor 133 can also include an acoustic sensor that detects noise levels. In some embodiments, the dispense application 139 can select a dispense profile 113 associated with lower noise levels in a quiet room and adjust the duty cycle selected for the motor 129 based upon detected noise levels in an environment in which the automated dispenser system 101 is installed.

In some embodiments, a dispense profile 113 can specify that the dispense cycle illustrated by graph 200 can be utilized during certain hours of the day, calendar days or days of the week, while the dispense profile 113 illustrated by graph 300 can be utilized during other hours of the day, calendar days or days of the week. For example, during lower traffic times or times when a quieter dispense cycle is desired, the dispense profile 113 can be configured to specify the dispense cycle illustrated by graph 300 should be used. During higher traffic times or during times when a faster dispense cycle is desired, the dispense profile 113 can be configured to specify the dispense cycle illustrated by graph 200.

To implement this scenario, the dispense profile 113 can specify time windows during which a faster motor 129 speed is utilized and other time windows during which a slower motor 129 speed is utilized. The controller 137 can determine which dispense cycle should be utilized by obtaining a current time or a timestamp of a proximity signal from the user sensor 133 or a removal signal from the removal sensor 123. The proximity signal can be used if the automated dispenser system 101 is operating in proximity mode and the removal signal can be used if the automated dispenser system 101 is operating in a hang mode. If the timestamp falls within a time window specified by the dispense profile 113 that indicates the faster motor 129 speed should be utilized, the dispense application 139 can select the dispense cycle illustrated by graph 200, for example. If the timestamp is within a time window that indicates, according to the dispense profile 113, that the slower motor 129 speed should be utilized, the dispense application 139 can select the dispense cycle illustrated by graph 300, for example.

FIGS. 4-7 illustrate alternative examples of dispense cycle behavior that can be utilized for second or subsequent dispense cycles that occur within the user timeout period relative to a previous removal or a previous dispense. As shown in the graph 400 of FIG. 4, a decelerating speed can be selected for the dispense cycle such that the speed of the motor 129 is decreasing from a higher speed to a lower speed during the dispense cycle. For example, the duty cycle of the motor 129 can begin at a peak level or 100% and decelerate at a constant rate until it reaches a lower or a 25% duty cycle by the end of the dispense cycle.

Figure 5:
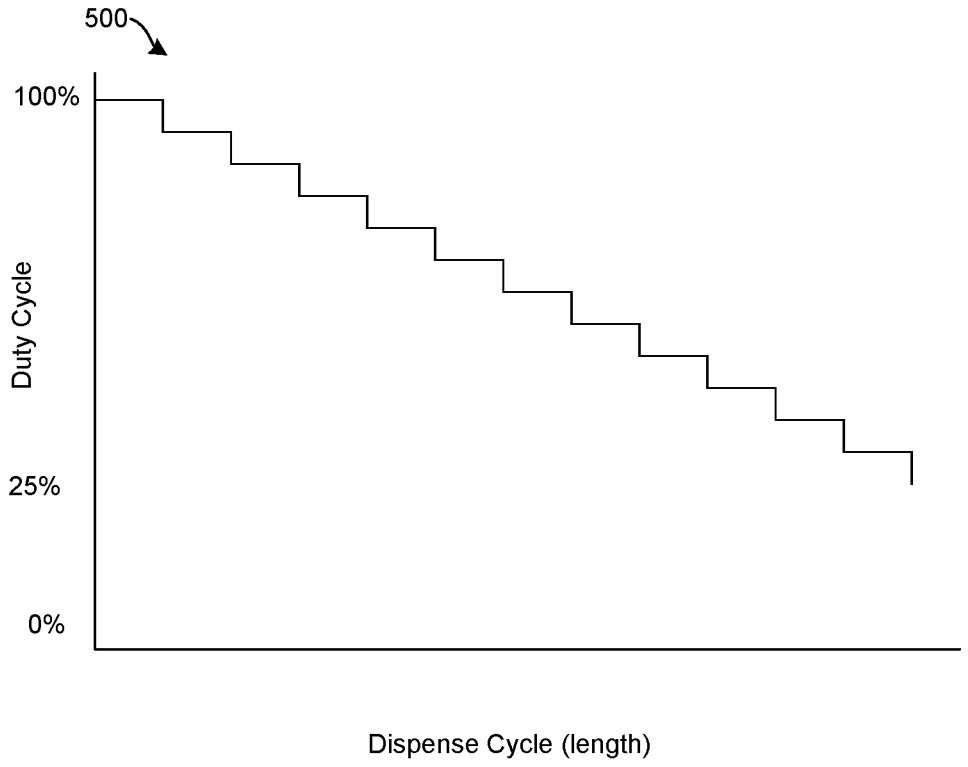
FIG. 5 is an example of a pulse width modulation graph for a portion of a dispense profile according to embodiments of the disclosure.

In the graph 500 of FIG. 5, a speed that successively steps down from a higher speed to a lower speed can be specified by the dispense profile 113. For example, if the dispense profile 113 specifies that at twelve inch sheet of product should be dispensed during a dispense cycle (assuming a removal is not detected that causes the dispense cycle to be stopped before completion), the speed of the motor 129 can be decreased after dispensing each inch of the sheet until the sheet is fully dispensed. In other words, the duty cycle of the motor 129 can begin at 100% and decelerate at a stepped down rate until it reaches a 25% duty cycle by the end of the dispense cycle.

Figure 4:
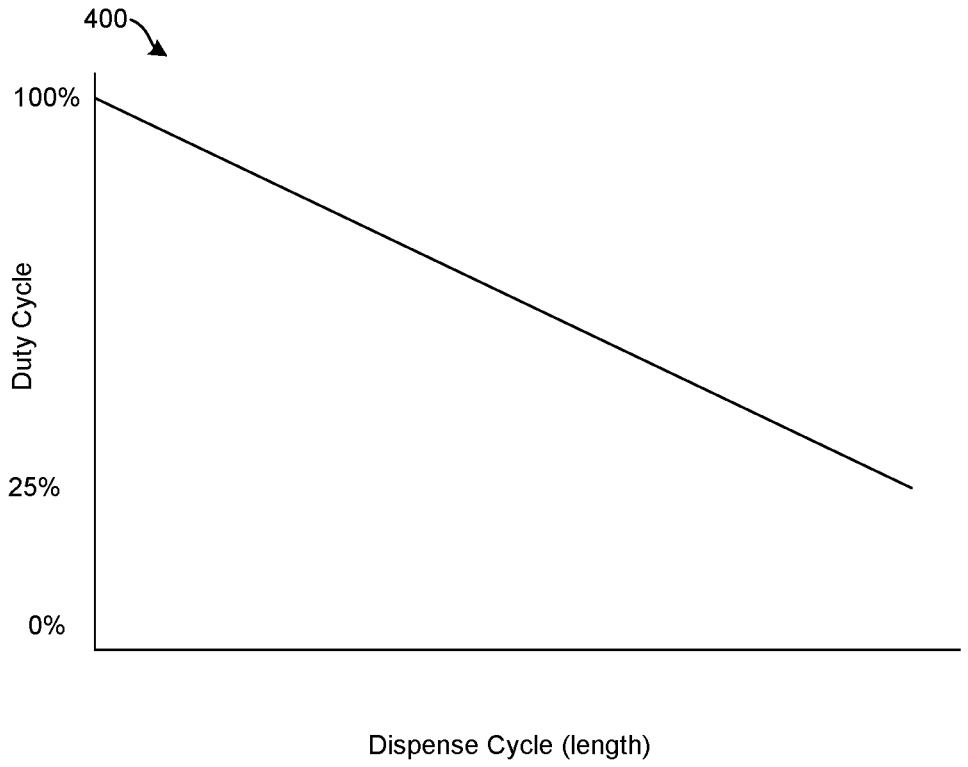
FIG. 4 is an example of a pulse width modulation graph for a portion of a dispense profile according to embodiments of the disclosure.

Relative to the continuously decelerating dispense cycle of FIG. 4, the stepped down dispense cycle of FIG. 5 can reduce the memory requirements for storing the dispense profile 113 and the processing requirements for executing the dispense profile 113, because only twelve different duty cycle parameters are required to be stored with the dispense profile 113 and executed by the dispense application 139. Additionally, the dispense application 139 need only change the duty cycle of the motor 129 after every inch of dispensing rather than continuously or at a finer level of granularity. In other implementations, the stepped down dispense cycle can be divided into more or fewer steps.

In one implementation, the dispense profile 113 can specify a high speed and a low speed during the dispense cycle. Beginning at the high speed at the initial portion of the dispense cycle, the duty cycle of the motor 129 can be decreased by $1/12^{th}$ after every inch of dispensing until the low speed and the end of the dispense cycle is reached.

Figure 6:
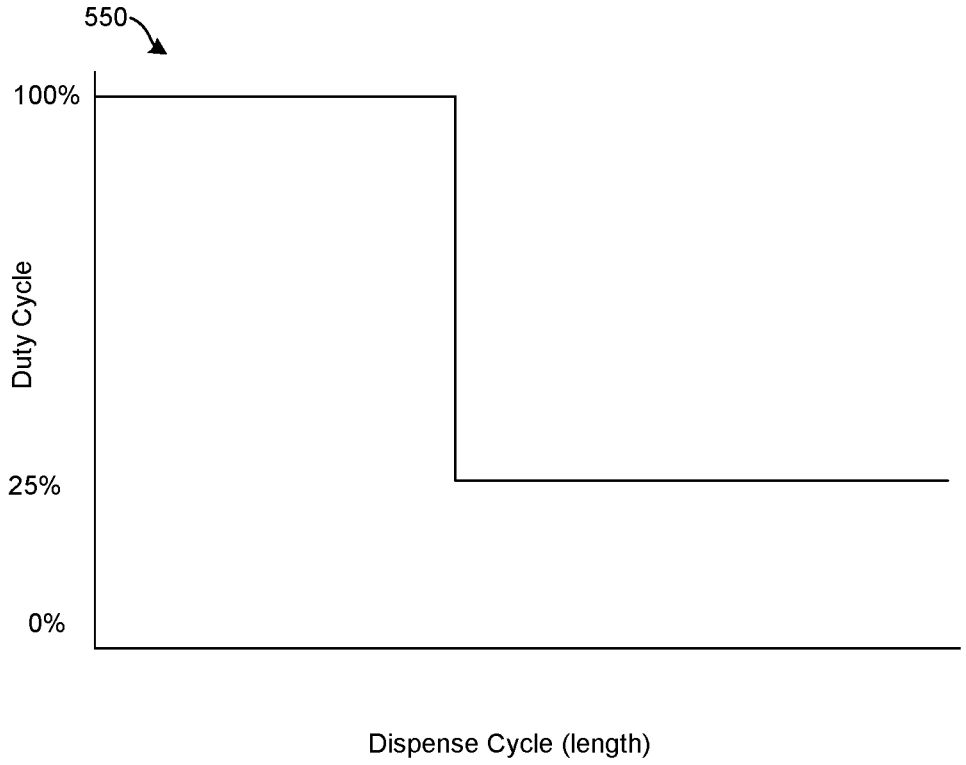
FIG. 6 is an example of a pulse width modulation graph for a portion of a dispense profile according to embodiments of the disclosure.

In the graph 550 of FIG. 6, the speed of the motor 129 can be decreased after an amount of sheet product has been initially dispensed at a speed that is similar to a previous removal or previous dispense. In the dispense profile 113 contemplated by the example of FIG. 6, a first dispense that is not within a user timeout period can be dispensed at full speed. For a second or subsequent dispense within the user timeout period, a first portion of the sheet product, such as 50% or another percentage of an amount of sheet product dispensed during a dispense cycle, can be dispensed at full speed just as a first dispense. A remainder of the sheet product during the second or subsequent dispense can be dispensed at a lower speed. In other words, the duty cycle of the motor 129 can begin at 100% for a first portion of the dispense cycle and change to a 25% duty cycle until the end of the dispense cycle.

In other examples, the remainder of the sheet product can be dispensed at a different speed or using a different duty cycle relative to the first portion. For example, the duty cycle of the motor 129 can begin at 100% for a first portion of the dispense cycle and change to a 40%, 50%, or other lower duty cycle until the end of the dispense cycle.

Figure 7:
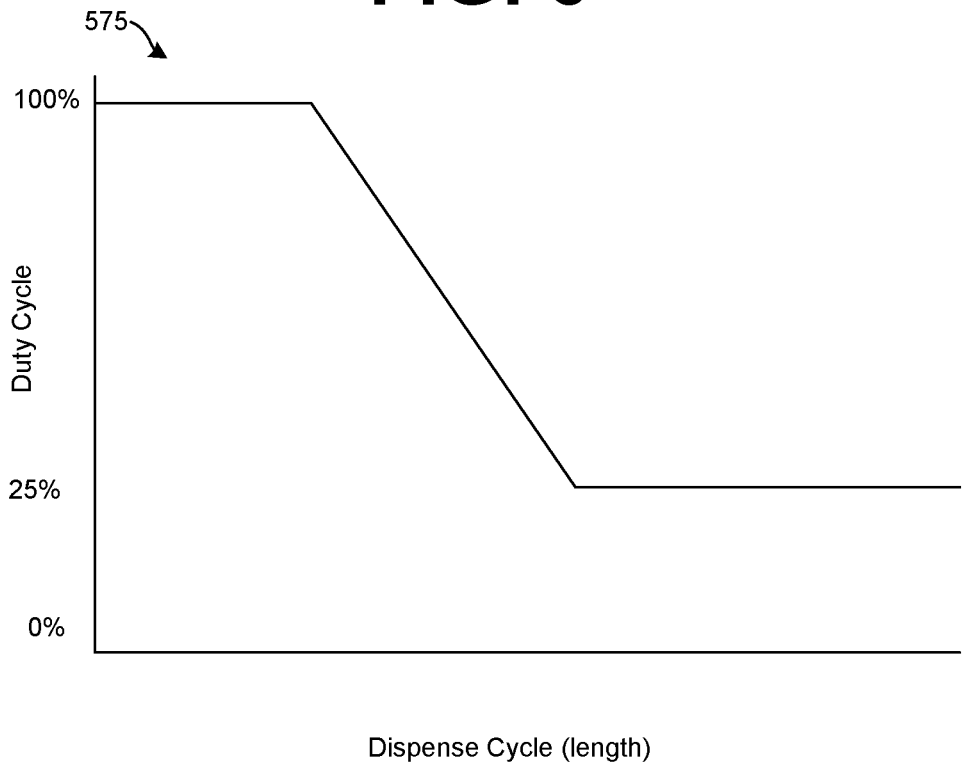
FIG. 7 is an example of a pulse width modulation graph for a portion of a dispense profile according to embodiments of the disclosure.

In the graph 575 of FIG. 7, the speed of the motor 129 can be decreased after an initial amount of sheet product has been dispensed at a speed that is similar to a previous removal or previous dispense. In the dispense profile 113 contemplated by the example of FIG. 7, a first dispense cycle that is not within a user timeout period can be dispensed at full speed or with the motor 129 being operated at a 100% duty cycle. For a second or subsequent dispense within the user timeout period, a first portion of the sheet product, such as 50% or another percentage of a total amount of sheet product dispensed during a dispense cycle, can be dispensed at a full motor duty cycle. A remainder of the sheet product during the second or subsequent dispense can be dispensed at a decreasing speed until a minimum speed is reached. In other words, the duty cycle of the motor 129 can begin at 100% for a first portion of the dispense cycle and decrease towards a 25% duty cycle until the end of the dispense cycle. The lower duty cycle can be reached by linearly decreasing the duty cycle at which the motor 129 is being operated or decrease in a stepped fashion as in the scenario depicted in FIG. 5. Additionally, the duty cycle can be reduced toward the minimum duty cycle in other ways, such as logarithmically, exponentially, or other by other forms of mathematically decaying functions.

In other examples, the remainder of the sheet product can be dispensed at a different speed or using a different duty cycle relative to the first portion. For example, instead of utilizing a 25% duty cycle as the minimum duty cycle, the duty cycle of the motor 129 can begin at 100% for a first portion of the dispense cycle and change to a 40%, 50%, or another lower duty cycle until the end of the dispense cycle or until a removal of the sheet product is detected.

Figure 8:
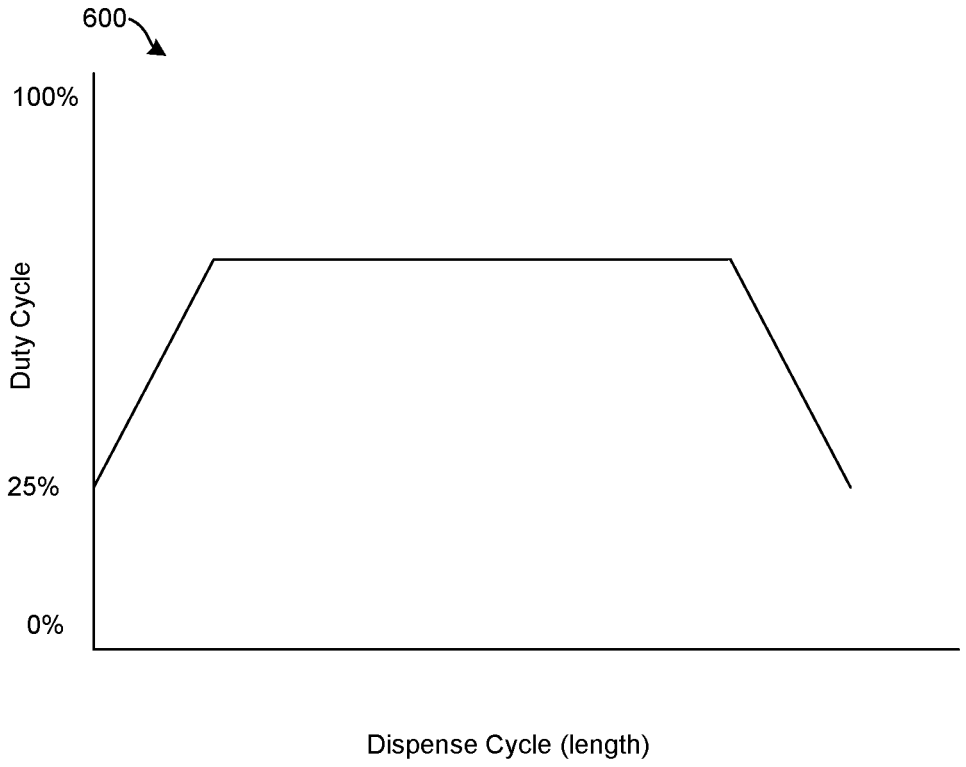
FIG. 8 is an example of a pulse width modulation graph for a portion of a dispense profile according to embodiments of the disclosure.

FIG. 8 illustrates an alternative example of a dispense cycle that can be specified by a dispense profile 113. In the graph 600 of FIG. 8, the dispense profile 113 can specify a dispense cycle that starts at a lower motor speed, increases to a higher motor speed for a portion of the dispense cycle, and then later decreases to a lower speed for a remainder of the dispense cycle.

In some implementations, users may prefer the dispense profile 113 illustrated by FIG. 8 or perceive the dispense profile 113 as a premium user experience. It should be noted that the dispense cycle illustrated by FIG. 8 can be implemented using a brushed DC motor by utilizing PWM control of the duty cycle of the motor 129 of the automated dispenser system 101 as illustrated in the graph 600.

The graphs 400, 500, 550, 575, and 600 of FIGS. 4-8 can illustrate a dispense cycle specified by a dispense profile 113 that is applied to all dispense cycles regardless of whether they occur during a user time period or not.

Figure 9:
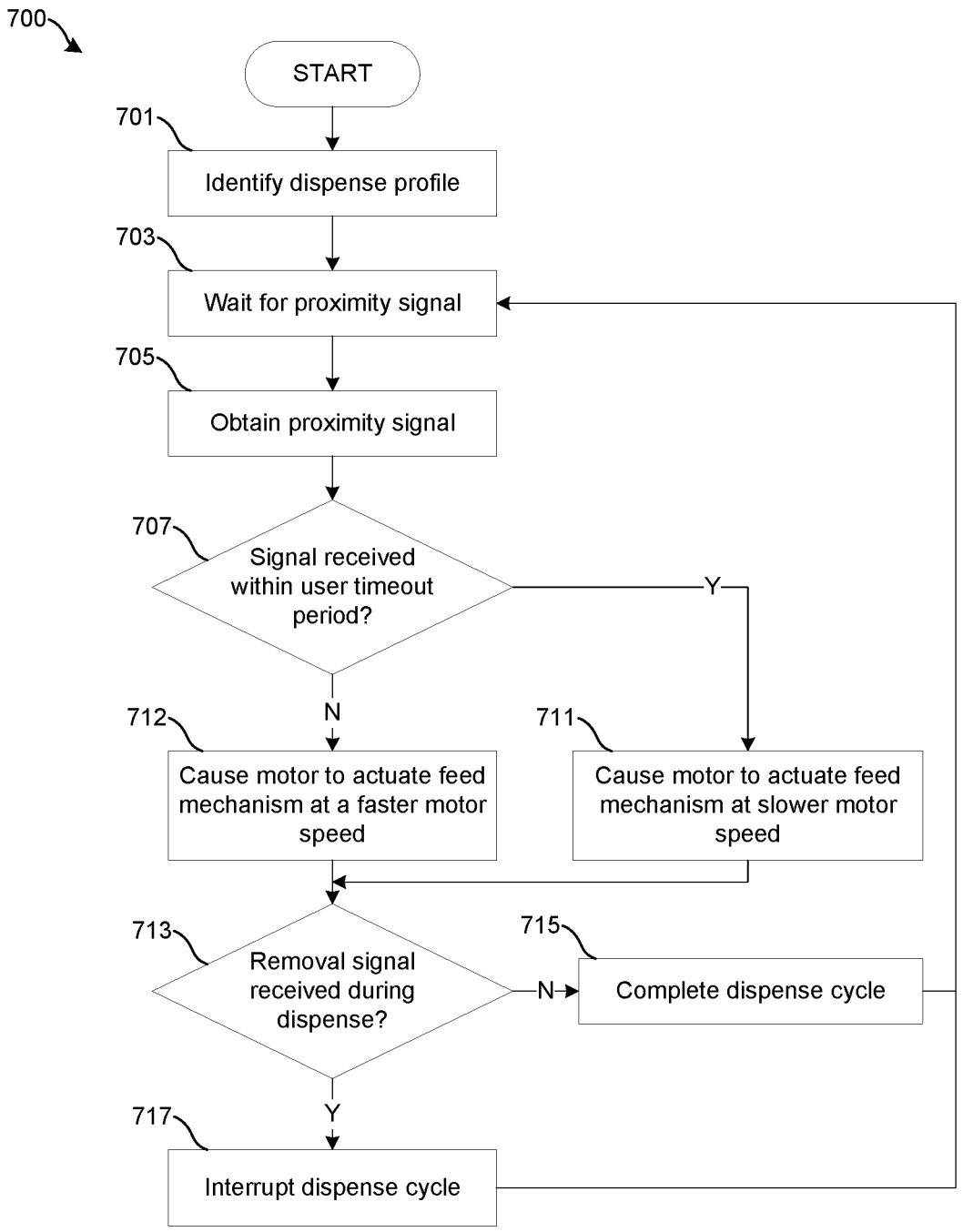
FIG. 9 is an example of a flowchart according to embodiments of the disclosure.

Reference is now made to FIG. 9, which illustrates a flowchart 700. The flowchart 700 of FIG. 9 is meant to depict a process or a method according to the disclosure. The method can be carried out by the automated dispenser system 101 or the dispense application 139 according to various embodiments.

First, at step 701, dispense application 139 can identify a dispense profile 113. Step 701 can be performed upon initial startup or when a dispense profile 113 is updated or a different dispense profile 113 is selected for operation in the automated dispenser system 101. A different dispense profile 113 could be selected by a user with administrative access to the automated dispenser system 101 to select or adjust a dispense profile 113 that is in use by the automated dispenser system 101. For the process shown in FIG. 7, the dispense profile 113 that is identified by the dispense application 139 is the profile with two dispense cycles as illustrated in FIGS. 2-3. Additionally, the dispense profile 113 causes the automated dispenser system 101 to operate in a proximity mode, where a dispense cycle occurs after detecting motion or proximity to the automated dispenser system 101.

At step 703, the dispense application 139 can wait for a proximity signal from a user sensor 133 of the automated dispenser system 101. The proximity signal represents motion or proximity to the automated dispenser system 101. At step 705, the dispense application 139 can obtain the proximity signal from the user sensor 133. In some embodiments, the dispense application 139 can wait for a proximity signal of a certain magnitude to be received and ignore a proximity signals that does not indicate a threshold level of proximity to the automated dispenser system 101. Obtaining a proximity signal indicates that a portion 127 of sheet product should be dispensed to the user.

Next, at step 707, the dispense application 139 can determine whether the proximity signal that is received by the dispense application 139 was received within a user timeout period relative to a previous dispense cycle. According to the dispense profile 113 identified at step 701, if a proximity signal is received within the user timeout period relative to a previous dispense, or in some implementations, a previous removal of sheet product, a slower dispense cycle can be selected. If a proximity signal is not received within the user timeout period relative to a previous dispense, or in some implementations, a previous removal of sheet product, a faster dispense cycle can be selected.

Accordingly, if the dispense application 139 determines at step 707 that the proximity signal was received within the user timeout period, the process proceeds to step 711. At step 711, the dispense application 139 causes the motor 129 to actuate the feed mechanism 117 to dispense a portion 127 of a specified length of sheet product from the product supply 115 to the user. The speed selected for the motor 129 for the dispense cycle can be a slower speed, such as a 25% duty cycle according to a PWM algorithm utilized to define the speed at which the motor 129 operates.

In some implementations, the slower speed can be achieved by dispensing the sheet product at a speed that continuously decreases during the dispense cycle as illustrated by graph 400. As another example, the slower speed can be achieved by periodically stepping down the duty cycle of the motor 129 and causing the speed of dispensing the sheet to decrease during the dispense cycle in a stepped down pattern as illustrated by graph 500.

In some implementations, the slower speed can also be achieved by dispensing a first portion of the specified length sheet product at a 100% duty cycle and a second portion of the specified length of the sheet product at a 25% duty cycle as illustrated by graph 550. In this scenario, the duty cycle of the motor 129 can be decreased to a to a minimum speed, which can be a 25% duty cycle, a 50% duty cycle, or another duty cycle that is less than a 100% duty cycle. In this way, the average speed of the dispense cycle is slower than the dispense cycle described at step 712.

In another implementation, the slower speed can also be achieved by dispensing a first portion of the specified length sheet product at a 100% duty cycle and a second portion of the specified length of the sheet product at a 25% duty cycle as illustrated by graph 575. In this scenario, the duty cycle of the motor 129 can be decreased linearly, in a stepped down manner, or by another progression to a minimum speed, which can be a 25% duty cycle, a 50% duty cycle, or another duty cycle that is less than a 100% duty cycle. In this way, the average speed of the dispense cycle is slower than the dispense cycle described at step 712.

If the dispense application 139 determines at step 707 that the proximity signal was not received within the user timeout period, the process proceeds to step 712. At step 712, the dispense application 139 causes the motor 129 to actuate the feed mechanism 117 to dispense a portion 127 of a specified length of sheet product from the product supply 115 to the user. The speed selected for the motor 129 for the dispense cycle can be a speed that is faster than if step 711 were performed, such as a 100% duty cycle according to a PWM algorithm utilized to define the speed at which the motor 129 operates. It should be noted that for a full dispense cycle, the motor 129 may operate for a shorter period of time at step 712 than at step 711 because in both scenarios, the specified length of the dispensed sheet product from the product supply 115 is approximately the same.

From step 711 or 712, the process proceeds to step 713. At step 713, the dispense application 139 can determine whether a removal signal is received from the removal sensor 123 during the dispense cycle. The removal signal can indicate that the user has torn or removed the sheet product before completion of the dispense cycle. If no removal signal is received, the process proceeds to step 715, where the dispense application 139 completes the dispense cycle by dispensing a full specified length of the sheet product from the product supply 115. Thereafter, the process can return to step 703, where the dispense application 139 can await a proximity signal and a subsequent dispense cycle.

If a removal signal is received during the dispense cycle at step 713, the process proceeds to step 717. At step 717, the dispense application 139 can interrupt the dispense cycle before completing the dispense cycle. In this way, waste or usage of the product supply 115 can be reduced by not dispensing a full specified length of the sheet product from the product supply 115. Thereafter, the process can return to step 703, where the dispense application 139 can await a proximity signal and a subsequent dispense cycle.

Figure 10:
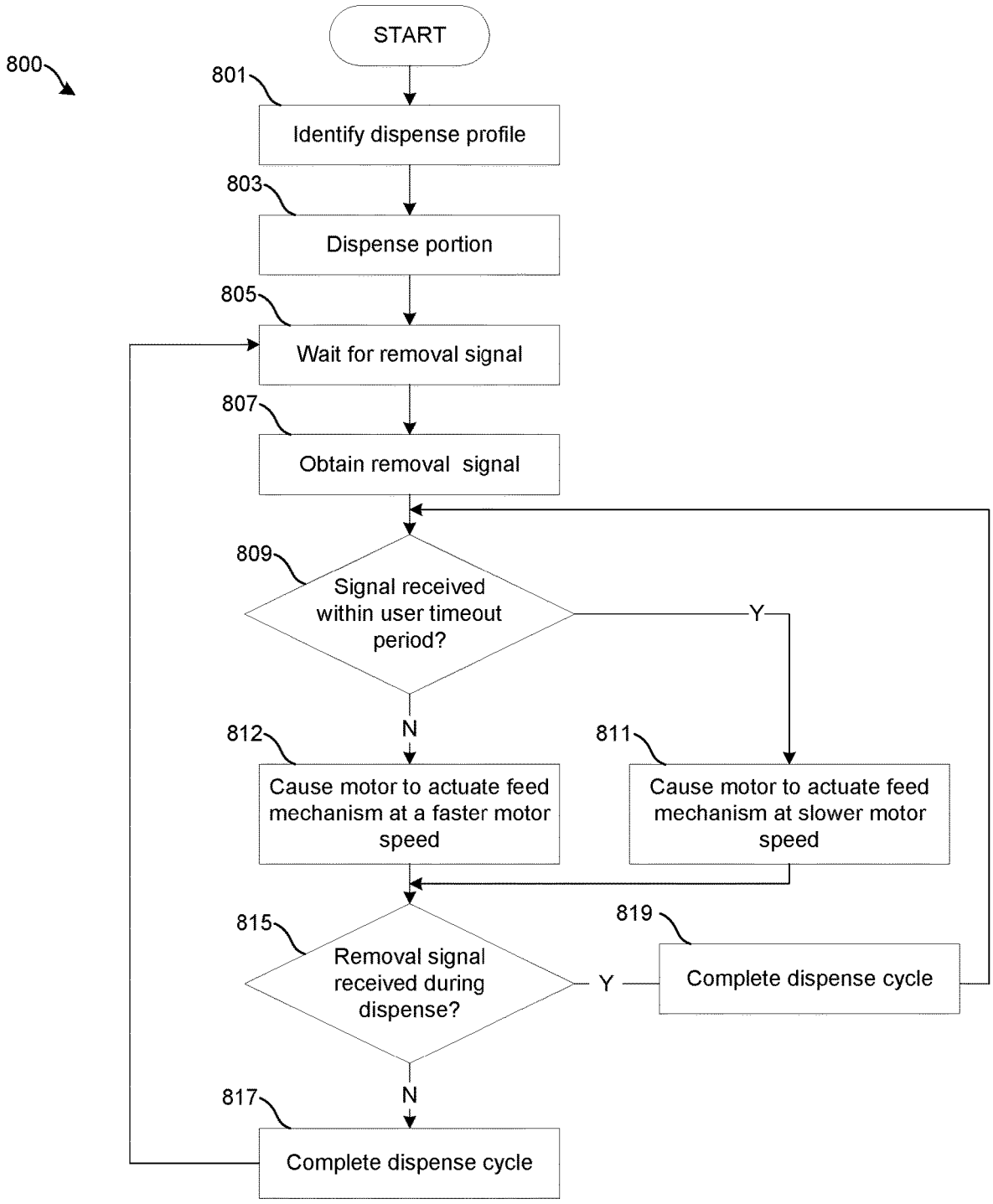
FIG. 10 is an example of a flowchart according to embodiments of the disclosure.

Reference is now made to FIG. 10, which illustrates a flowchart 800. The flowchart 800 of FIG. 10 is meant to depict a process or a method according to the disclosure. The method can be carried out by the automated dispenser system 101 or the dispense application 139 according to various embodiments.

First, at step 801, dispense application 139 can identify a dispense profile 113. Step 801 can be performed upon initial startup or when a dispense profile 113 is updated or a different dispense profile 113 is selected for operation in the automated dispenser system 101. Again, a different dispense profile 113 could be selected by a user with administrative access to the automated dispenser system 101 to select or adjust a dispense profile 113 that is in use by the automated dispenser system 101. For the process shown in FIG. 8, the dispense profile 113 that is identified by the dispense application 139 is the profile with two dispense cycles as illustrated in FIGS. 2-3. Additionally, the dispense profile 113 causes the automated dispenser system 101 to operate in a hang mode, where a dispense cycle occurs on initial startup, loading of a product supply 115, and/or after detecting removal of a portion 127 of dispensed sheet product by the automated dispenser system 101.

At step 803, the dispense application 139 can dispense a portion 127 of the sheet product from the product supply 115. The portion 127 can be dispensed in the hang mode so that a dispensed sheet is awaiting a user of the automated dispenser system 101. Subsequent sheets can be dispensed after detecting a removal of the dispensed sheet by the removal sensor 123.

At step 805, the dispense application 139 can await a removal signal from the removal sensor 123. The removal signal represents removal or tearing of the dispensed portion 127 of the sheet product from the automated dispenser system 101 that is presented to the user.

At step 807, the dispense application 139 can obtain the removal signal from the removal sensor 123. Obtaining the removal signal indicates that a portion 127 of sheet product should be dispensed so that it awaits the user. However, according to the dispense profile 113 selected, the speed of the dispense cycle can be adjusted depending on whether the removal signal was received within a user timeout period relative to a previous dispense cycle.

Next, step 809, the dispense application 139 can determine whether the removal signal that is received by the dispense application 139 was received within a user timeout period relative to a previous dispense cycle. According to the dispense profile 113 identified at step 801, if a removal signal is received within the user timeout period relative to a previous dispense cycle, a slower dispense cycle can be selected. If the removal signal is not received within the user timeout period relative to a previous dispense cycle, a faster dispense cycle can be selected.

Accordingly, if the dispense application 139 determines at step 809 that the removal signal was received within the user timeout period, the process proceeds to step 811. At step 811, the dispense application 139 causes the motor 129 to actuate the feed mechanism 117 to dispense a portion 127 of a specified length of sheet product from the product supply 115 to the user. The speed selected for the motor 129 for the dispense cycle can be a slower speed, such as a 25% duty cycle according to a PWM algorithm utilized to define the speed at which the motor 129 operates.

If the dispense application 139 determines at step 809 that the removal signal was not received within the user timeout period, the process proceeds to step 812. At step 812, the dispense application 139 causes the motor 129 to actuate the feed mechanism 117 to dispense a portion 127 of a specified length of sheet product from the product supply 115 to the user. The speed selected for the motor 129 for the dispense cycle can be a speed that is faster than if step 811 were performed, such as a 100% duty cycle according to a PWM algorithm utilized to define the speed at which the motor 129 operates. It should be noted that for a full dispense cycle, the motor 129 may operate for a shorter period of time at step 812 than at step 811 because in both scenarios, the specified length of the dispensed sheet product from the product supply 115 is approximately the same.

From step 811 or 812, the process proceeds to step 815. At step 815, the dispense application 139 can determine whether a removal signal is received from the removal sensor 123 during the dispense cycle. The removal signal can indicate that the user has torn or removed the sheet product before completion of the dispense cycle. If no removal signal is received, the process proceeds to step 817, where the dispense application 139 completes the dispense cycle by dispensing a full specified length of the sheet product from the product supply 115. Thereafter, the process can return to step 805, where the dispense application 139 can await a removal signal and a subsequent dispense cycle.

If a removal signal is received during the dispense cycle at step 815, the process can proceed to step 819. At step 819, the dispense application 139 can interrupt the dispense cycle. Once the user has removed the portion 127 of the sheet being dispensed from the product supply 115, there is not a need to complete the dispense cycle, which can result in a reduction in waste or usage of the product supply 115. Thereafter, the process can return to step 809, where the dispense application 139 can dispense the next portion 127 from the product supply 115.

At steps 711 and 811 of FIGS. 9 and 10, the slower motor speed can be selected based upon the current levels of the power source 147. In other words, the dispense profile 113 executed by the controller 137 can adjust a slower motor speed utilized for a dispense cycle in a manner that compensates for measured battery voltage of the power source 147, assuming the power source 147 is a battery that degrades over time. In an implementation where a DC motor is selected that is powered by one or more DC batteries, the motor 129 speed for a given duty cycle used for the motor 129 can be slower over time as the batteries become depleted.

For example, the actual speed of the motor 129 during a dispense cycle at the same duty cycle changes throughout the life of the batteries used as the power source 147. When running the motor 129 at lower duty cycles, such as those proposed in examples of this disclosure, the motor 129 may stall when batteries are significantly depleted.

Accordingly, dispense profiles 113 executed by the controller 137 can utilize a battery compensation mechanism to reduce the risk of a battery that stalls during a dispense cycle. For example, for a dispense profile 113 that utilizes a lower motor speed for a second or subsequent dispense within a user timeout period, the motor 129 might be asked to utilize a 100% duty cycle for a first dispense and a 25% duty cycle for at least a portion of a second or subsequent dispense. However, batteries utilized as the power source 147 that have been depleted may not reliably power the motor 129 at a 25% duty cycle. Therefore, a compensation table can be utilized that increases the duty cycle utilized when a slower motor speed is utilized. The increase in the duty cycle that is utilized is based on the power levels remaining in the batteries used at the power source 147. One example compensation table is shown below:

TABLE 1

| Duty Cycle Adjustment Percentage | Battery Percentage Remaining |
|---|---|
| 0 | 95 |
| 0 | 90 |
| 0 | 85 |
| 0 | 80 |
| 1 | 75 |
| 2 | 70 |
| 3 | 65 |
| 5 | 60 |
| 6 | 55 |
| 7 | 50 |
| 9 | 45 |
| 10 | 40 |

TABLE 1-continued

| Duty Cycle Adjustment Percentage | Battery Percentage Remaining |
|---|---|
| 11 | 35 |
| 13 | 30 |
| 14 | 25 |
| 15 | 20 |
| 17 | 15 |
| 18 | 10 |
| 19 | 5 |
| 20 | 0 |

As shown in Table 1, if the battery levels remaining in the power source 147 are 95% of the original levels or 95% of a reference voltage as measured in one or more batteries utilized as the power source 147, the duty cycle utilized by the motor is not adjusted for a dispense occurring at a slower speed or at a lower duty cycle. On the other hand, if the batteries in the power source 147 are at 5% remaining life, 19% can be added to the duty cycle of a portion of a dispense cycle that utilizes a that occurs at a lower speed. For example, for a dispense profile 113 that utilizes a dispense cycle as illustrated in FIG. 6, 19% can be added to the duty cycle of the portion of the dispense cycle for which a 25% duty is contemplated by the dispense profile 113. For a dispense profile 113 that utilizes a dispense cycle as illustrated in FIG. 7, 19% can be added to the duty cycle of the portion of the dispense cycle that is 81% or lower so that more than a 100% duty cycle is not attempted. Additionally, if the batteries in the power source 147 are at 5% remaining life and a dispense profile 113 specifies a duty cycle that is greater than 81%, the duty cycle can be compensated up to 100% rather than adding 19% to the duty cycle specified in the dispense profile 113 so that more than a 100% duty cycle is not attempted.

Compensating for low battery levels in this way can reduce the possibility of the motor 129 from stalling when a lower speed is selected by the controller 137 as directed by the dispense profile 113. In addition to reducing the possibility of stalls at low duty cycles, the compensation mechanism can also maintain a more consistent user experience throughout the life of batteries utilized as a power source 147 in the automated dispenser system 101. Accordingly, in a washroom with multiple automated dispenser systems 101 with different battery levels, performance across the automated dispenser systems 101 can remain consistent in a side-by-side comparison.

In another scenario, a compensation table can also be utilized for an initial dispense, or a full-speed dispense of sheet product from the automated dispenser system 101. In this scenario, rather than a 100% duty cycle utilized for an initial dispense, a dispense profile 113 can utilize a lower duty cycle, such as 50% or any amount that is less than 100% by as much as the largest duty cycle adjustment percentage in the compensation table. By utilizing a battery level compensation table for an initial dispense as well, consistent performance can be maintained for more of the life of the batteries utilized as the power source 147.

The compensation table shown in Table 1 is just one example of a compensation table that can be utilized to adjust for varying battery levels. A compensation table with more or fewer adjustment percentages for measured battery levels can also be utilized so long as the compensation table directs the controller 137 to increase the duty cycle of the motor 129 for certain dispense cycles as the batteries of the power source 147 degrade over time.

The flowcharts show an example of the functionality and operation of an implementation of portions of components described. If embodied in software, each block can represent a module, segment, or portion of code that can include program instructions to implement the specified logical function(s). The program instructions can be embodied in the form of source code that can include human-readable statements written in a programming language or machine code that can include numerical instructions recognizable by a suitable execution system such as a processor in a computer system or other system. The machine code can be converted from the source code. If embodied in hardware, each block can represent a circuit or a number of interconnected circuits to implement the specified logical function(s).

Although the flowcharts show a specific order of execution, it is understood that the order of execution can differ from that which is depicted. For example, the order of execution of two or more blocks can be scrambled relative to the order shown. In addition, two or more blocks shown in succession can be executed concurrently or with partial concurrence. Further, in some embodiments, one or more of the blocks shown in the drawings can be skipped or omitted.

Also, any logic or application described that includes software or code can be embodied in any non-transitory computer-readable medium for use by or in connection with an instruction execution system such as a processor in a computer system or other system. In this sense, the logic can include, for example, statements including instructions and declarations that can be fetched from the computer-readable medium and executed by the instruction execution system. In the context of the present disclosure, a "computer-readable medium" can be any medium that can contain, store, or maintain the logic or application described for use by or in connection with the instruction execution system.

The computer-readable medium can include any one of many physical media, such as magnetic, optical, or semiconductor media. More specific examples of a suitable computer-readable medium include solid-state drives or flash memory. Further, any logic or application described can be implemented and structured in a variety of ways. For example, one or more applications can be implemented as modules or components of a single application. Further, one or more applications described can be executed in shared or separate computing devices or a combination thereof. For example, a plurality of the applications described can execute in the same computing device, or in multiple computing devices.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that measurements, amounts, and other numerical data can be expressed herein in a range format. It is also understood that there are a number of values disclosed herein, and that each value is also herein disclosed as "approximately" that particular value in addition to the value itself. For example, if the value "10" is disclosed, then "approximately 10" is also disclosed. Similarly, when values are expressed as approximations, by use of the antecedent "approximately," it will be understood that the particular value forms a further aspect. For example, if the value "approximately 10" is disclosed, then "10" is also disclosed.

As used herein, the terms "about," "approximately," "at or about," and "substantially equal" can mean that the amount or value in question can be the exact value or a value that provides equivalent results or effects as recited in the claims or taught herein. That is, it is understood that amounts, sizes, measurements, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In general, an amount, size, measurement, parameter or other quantity or characteristic is "about," "approximate," "at or about," or "substantially equal" whether or not expressly stated to be such. It is understood that where "about," "approximately," "at or about," or "substantially equal" is used before a quantitative value, the parameter also includes the specific quantitative value itself, unless specifically stated otherwise.

Where a range is expressed, a further aspect includes from the one particular value and/or to the other particular value. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

Such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

It is emphasized that the above-described embodiments of the present disclosure are merely possible examples of implementations described for a clear understanding of the principles of the disclosure. Many variations and modifications can be made to the above-described embodiments without departing substantially from the spirit and principles of the disclosure. All such modifications and variations are intended to be included within the scope of this disclosure.

Therefore, the following is claimed:

1. An automated dispenser system, comprising:

a feed mechanism configured to dispense consumable product from a product supply;

a motor mechanically coupled to the feed mechanism;

a user sensor;

a removal sensor;

a data store storing at least two dispense profiles, each dispense profile having at least one parameter, the parameter being one of a speed at which the motor actuates the feed mechanism during dispensing of the consumable product, an amount of consumable product dispensed, a time period for actuating the feed mechanism, a time threshold between actuations of the feed mechanism, a time of day for utilizing the dispense profile, or a specific event for utilizing the dispense profile; and an application executable by a processor, the application, when executed by the processor, causing the processor to at least:

select a dispense profile from among the at least two dispense profiles stored in the data store;

obtain a first proximity signal indicating proximity to the automated dispenser system from the user sensor; and cause the motor to actuate the feed mechanism in accordance with the at least one parameter of the selected dispense profile during a first dispense cycle to dispense a first portion of the consumable product.

2. The automated dispenser system of claim 1, wherein the application further causes the processor to at least:

obtain a first removal signal from the removal sensor indicating that the first portion of the consumable product has been removed from the automated dispenser system;

determine that an amount of time since completion of the first dispense cycle is within the time threshold specified by the selected dispense profile; and cause the motor to actuate the feed mechanism at a second speed during a second dispense cycle as specified by the selected dispense profile to dispense a second portion of the consumable product, wherein the second speed is less than a first speed at which the motor actuates the feed mechanism during the first dispense cycle.

3. The automated dispenser system of claim 2, wherein the first dispense cycle is shorter than the second dispense cycle such that the first portion of the consumable product is equivalent to the second portion of the consumable product.

4. The automated dispenser system of claim 2, wherein the application selects a speed of the motor using a pulse width modulation (PWM) signal, and the application further causes the processor to at least select the second speed by lowering a duty cycle of the PWM signal.

5. The automated dispenser system of claim 1, wherein the application further causes the processor to at least:

obtain a first removal signal from the removal sensor indicating that the first portion of the consumable product has been removed from the product dispenser;

determine that an amount of time since completion of the first dispense cycle is within the time threshold specified by the selected dispense profile; and cause the motor to actuate the feed mechanism at a decelerating speed during a second dispense cycle as specified by the selected dispense profile to dispense a second portion of the consumable product.

6. The automated dispenser system of claim 1, wherein the application further causes the processor to at least:

obtain a first removal signal from the removal sensor indicating that the first portion of the consumable product has been removed from the product dispenser;

determine that an amount of time since completion of the first dispense cycle is greater than the time threshold specified by the selected dispense profile; and cause the motor to actuate the feed mechanism at the first speed during a second dispense cycle as specified by the selected dispense profile to dispense a second portion of the consumable product.

7. The automated dispenser system of claim 1, wherein the application further causes the processor to at least:

identify a timestamp associated with the first proximity signal;

determine that the selected dispense profile specifies a respective motor speed for a plurality of time windows; and set a first motor speed for the first dispense cycle to the respective motor speed specified by a time window in which the timestamp falls.

8. The automated dispenser system of claim 1, wherein the application further causes the processor to at least:

cause the motor to actuate the feed mechanism at a first speed during a first portion of the first dispense cycle; and cause the motor to accelerate actuation of the feed mechanism to a second speed during a second portion of the first dispense cycle.

9. The automated dispenser system of claim 8, wherein the application further causes the processor to at least:

cause the motor to decelerate actuation of the feed mechanism to a third speed during a third portion of the first dispense cycle.

10. The automated dispenser system of claim 1, wherein the feed mechanism further comprises:

a drive roller coupled to the motor, the drive roller configured to extract the consumable product from the product supply; and a pinch roller positioned in proximity to the drive roller, wherein the consumable product is fed between the drive roller and the pinch roller.

11. The automated dispenser system of claim 1, further comprising a motor encoder configured to generate feedback data regarding a rotational velocity of the motor.

12. The automated dispenser system of claim 1, wherein selecting the dispense profile from among the at least two dispense profiles is based on at least one of: an environment in which the automated dispenser system is deployed, the time of day, or a user selection.

13. A method comprising:

selecting, by an application executed by a processor of an automated dispenser system, a dispense profile from among at least two dispense profiles stored in a data store, each dispense profile having at least one parameter, the parameter being one of a speed at which the motor actuates the feed mechanism during dispensing of the consumable product, an amount of consumable product dispensed, a time period for actuating the feed mechanism, a time threshold between actuations of the feed mechanism, a time of day for utilizing the dispense profile, or a specific event for utilizing the dispense profile, the feed mechanism configured to extract sheet product from a product supply;

obtaining, by the application, a first removal signal from a removal sensor indicating removal of a first portion of the sheet product dispensed during a first dispense cycle from the automated dispenser system; and causing the motor to actuate the feed mechanism in accordance with the at least one parameter of the selected dispense profile during a second dispense cycle to dispense a second portion of the sheet product.

14. The method of claim 13, further comprising:

obtaining a second removal signal from the removal sensor indicating that the second portion of the consumable product has been removed from the automated dispenser system;

determine that an amount of time since completion of the second dispense cycle is within the time threshold specified by the selected dispense profile; and cause the motor to actuate the feed mechanism at a second speed during a third dispense cycle as specified by the selected dispense profile to dispense a second portion of the consumable product, wherein the second speed is less than a first speed at which the motor actuates the feed mechanism during the first dispense cycle or a decelerating speed.

15. The method of claim 14, wherein the second dispense cycle is shorter than the third dispense cycle such that the second portion of the consumable product is equivalent to the third portion of the consumable product.

16. The method of claim 13, further comprising selecting a speed of the motor using a pulse width modulation (PWM) signal, and the application further causes the processor to at least select the second speed by lowering a duty cycle of the PWM signal.

17. The method of claim 13, further comprising:

obtaining a second removal signal from the removal sensor indicating that the second portion of the consumable product has been removed from the automated dispenser system;

determine that an amount of time since completion of the second dispense cycle is greater than the time threshold specified by the selected dispense profile; and cause the motor to actuate the feed mechanism at a first speed during a third dispense cycle as specified by the selected dispense profile to dispense a second portion of the consumable product.

18. The method of claim 13, further comprising:

identify a timestamp associated with the first removal signal;

determine that the selected dispense profile specifies a respective motor speed for a plurality of time windows; and set a first motor speed for the first dispense cycle to the respective motor speed specified by a time window in which the timestamp falls.

19. The method of claim 13, further comprising:

causing the motor to actuate the feed mechanism at a first speed during a first portion of the second dispense cycle; and causing the motor to accelerate actuation of the feed mechanism to a second speed during a second portion of the second dispense cycle.

20. The method of claim 19, further comprising:

causing the motor to decelerate actuation of the feed mechanism to a third speed during a third portion of the second dispense cycle.

21. The method of claim 13, wherein selecting the dispense profile from among the at least two dispense profiles is based on at least one of: an environment in which the automated dispenser system is deployed, the time of day, or a user selection.

22. An automated dispenser system, comprising:

a feed mechanism configured to dispense consumable product from a product supply;

a motor mechanically coupled to the feed mechanism;

a user sensor;

a data store storing at least one dispense profile, wherein the dispense profile has at least one parameter corresponding to operation of the dispenser system, wherein the dispense profile has at least a first time window and a second time window, wherein the first time window is different than the second time window, wherein the first time window has a different parameter than the second time window such that the dispenser system operates differently during the first time window versus during the second time window; and an application executable by a processor, the application, when executed by the processor, causing the processor to at least:

obtain a first proximity signal indicating proximity to the automated dispenser system from the user sensor;

identify a timestamp associated with the first proximity signal;

determine that the timestamp falls within the first time window; and cause the dispenser system to operate according to the at least one parameter as specified by the dispense system for operation during the first time window.

* * * * *